US010343261B2

(12) United States Patent
Mack

(10) Patent No.: US 10,343,261 B2
(45) Date of Patent: Jul. 9, 2019

(54) VISE STOP ARRANGEMENT

(71) Applicant: Edward Mack, Bothell, WA (US)

(72) Inventor: Edward Mack, Bothell, WA (US)

(73) Assignee: Concepts To Solutions, LLC, Everett, WA (US)

( * ) Notice: Subject to any disclaimer, the term of this patent is extended or adjusted under 35 U.S.C. 154(b) by 0 days.

(21) Appl. No.: 16/011,891

(22) Filed: Jun. 19, 2018

(65) Prior Publication Data

US 2018/0311793 A1 Nov. 1, 2018

Related U.S. Application Data

(60) Provisional application No. 62/523,088, filed on Jun. 21, 2017.

(51) Int. Cl.
*B25B 1/24* (2006.01)

(52) U.S. Cl.
CPC ..... *B25B 1/2468* (2013.01)

(58) Field of Classification Search
CPC .... B25B 1/00; B25B 1/02; B25B 1/20; B25B 1/2421; B25B 5/00; B25B 11/00
See application file for complete search history.

(56) References Cited

U.S. PATENT DOCUMENTS

| | | | | |
|---|---|---|---|---|
| 5,996,986 | A | 12/1999 | Ewing | |
| 6,361,034 | B1 * | 3/2002 | Wolfe | B25B 1/2463 269/247 |
| 6,641,125 | B2 | 11/2003 | Bentley | |
| 6,672,578 | B1 * | 1/2004 | Martens | B25B 1/2452 269/261 |
| 7,152,855 | B1 | 12/2006 | Martens | |
| 8,002,254 | B2 * | 8/2011 | Bayer | B23Q 1/0018 269/20 |
| 8,066,270 | B2 * | 11/2011 | Siegel | B25B 1/2452 269/272 |
| 2015/0091232 | A1 * | 4/2015 | Meagher, Jr. | B23Q 3/069 269/274 |
| 2018/0311793 | A1 * | 11/2018 | Mack | B25B 1/2468 |

* cited by examiner

*Primary Examiner* — Lee D Wilson
(74) *Attorney, Agent, or Firm* — Puget Patent; Michael Gibbons

(57) ABSTRACT

An arrangement of a carrier plate and vise stop which provide an abutment against which a workpiece rests laterally when being milled. The carrier plate affixes to a rear portion of a fixed jaw of a milling machine, the carrier plate having a forward recess for receiving the rear portion of the fixed jaw which nestles into the recess as the recess is dimensioned for receiving at least three sides of the fixed jaw. The carrier plate includes a plurality of locator chambers sized for receiving dowel pins of a vise stop, whereby adjacent locator chambers are spaced at a constant distance apart from one another. The interlocking of the dowels of the vise stop and the carrier plate may occur at varied lateral locations between the sides of the milling machine. A nose of the vise stop extends into the work area of the milling machine, providing the abutment.

20 Claims, 5 Drawing Sheets

VISE STOP ARRANGEMENT

PRIORITY CLAIM

The present application is related to and/or claims the benefits of the earliest effective priority date and/or the earliest effective filing date of the below-referenced applications, each of which is hereby incorporated by reference in its entirety, to the extent such subject matter is not inconsistent herewith, as if fully set forth herein:

(1) this application constitutes a non-provisional of U.S. Provisional Patent Application No. 62/523,088, entitled WORK PIECE POSITIONING ASSEMBLY AND HEM-BACK VISE, naming Edward Mack as the inventor, filed Jun. 21, 2017, which is currently is an application of which a currently co-pending application is entitled to the benefit of the filing date.

FIELD OF THE INVENTION

This invention relates generally to work holders, particularly of the work-stop abutment type, and, more specifically, to a vise stop arrangement.

BACKGROUND OF THE INVENTION

When milling a workpiece using a milling machine, it is necessary to hold the workpiece in position within the machine prior to applying a milling tool to the workpiece. Typically, a milling machine has a bed on which the workpiece sits and a fixed jaw towards the back of the milling machine against which the workpiece rests. A movable jaw is disposed towards the front of the milling machine, and the movable jaw may be moved from front to back typically through actuation of a worm gear arrangement. Spinning a handle at the front of the milling machine engages the worm gear, moving the movable jaw from front to back, enabling an operator to pin the workpiece in between the movable jaw and the fixed jaw, atop the bed of the milling machine.

A prior art vise stop may be clamped to the fixed jaw, the vise stop providing a surface extending into the milling machine work area against which the workpiece can come to rest laterally. A vise stop ensures that a workpiece does not slide laterally in between the movable jaw and fixed jaw while being milled. A typical prior art vise stop is an "Interstate 1 Piece Vise Work Stop" which may be viewed via the internet at the website of MSC Direct at www.mscdirect.com/product/details/56450521. However, neither a typical milling machine nor a typical prior art vise stop have any arrangement for enabling a prior art vise stop to be coupled with the fixed jaw of the milling machine at the same lateral station from the side of the milling machine in successive couplings of the prior art vise stop to the fixed jaw. Further, a prior art vise stop typically clamps into place with no other means for locking it into place such that sufficient force applied laterally will eventually cause the prior art vise stop to slide out of position. The disclosed invention provides a vise stop arrangement which enables a vise stop to be coupled with the fixed jaw at more precise lateral station from the side of the milling machine along the fixed jaw, the lateral station having been selected by the operator in accordance with the needs of a particular milling project. Further, unlike a prior art vise stop, the disclosed vise stop arrangement interfaces with the milling machine at multiple points and in multiple directions, resisting any tendency of the vise stop arrangement to slide out of position under pressure.

DESCRIPTION OF RELATED ART

U.S. Pat. No. 5,996,986 issued to Harold E. Ewing on Dec. 7, 1999 discloses a vise stop that enables an operator to precisely position parts in a vise. Ewing does not appear to disclose an arrangement for setting the vise stop at a particular position and then precisely resetting the vise stop at that same particular position at a later time after intermediate use of the milling machine has required a change in the lateral position of the vise stop.

U.S. Pat. No. 6,641,125 to Donald R. Bentley on Nov. 4, 1963 discloses a vise stop arrangement in which lateral travel of a workpiece is stopped using threaded stop tips which are adjusted through rotation of lock nuts that rotate the threaded stop tips. As the threaded stop tips can be rotated to any position, like Ewing, there is no provision for movement of a threaded stop tip to a precisely defined lateral position in subsequent milling operations.

U.S. Pat. No. 7,152,855 to Michael R. Martens on Dec. 26, 2006 discloses a vise stop arrangement in which the fixed jaw which is a part of the milling machine is replaced with a new fixed jaw having a series of laterally-spaced grooves in the top of the fixed jaw. A key or other stop attaches to the groove and has a portion which extends into the work area of the milling machine, acting as a stop. A threaded channel is in the bed of each groove for receiving a threaded fastener which is passed through the key. Martens's solution provides a way of reproducibly electing a particular lateral position for providing a stop (the key) against which a workpiece to be milled rests. However, the key is very small and potentially lacks durability. The integrity of the key is further compromised by the channel disposed through its center which is used for the attachment of the key to the top of the vise jaw, the channel representing a potential point of failure of the key when the workpiece is rested against it and subjected to force during milling operations.

SUMMARY

The disclosed invention provides a vise stop which rests over the top of the fixed jaw and is supported at multiple points. The vise stop is coupled with a carrier plate, the carrier plate having been attached at the rear of the milling machine to the back face of the fixed jaw. A plurality of locator chambers is disposed through the carrier plate longitudinally (i.e. from front to back, parallel to the worm screw that engages the movable jaw), and each locator chamber is spaced the same distance from adjacent locator chambers. The vise stop has at least two dowels which are inserted into particular locator chambers in the carrier plate. While the vise stop may have two dowels, the carrier plate may have 10, 20 or more locator chambers disposed laterally at a constant spacing, which means that the vise stop may be engaged with the carrier plate at a selected offset from the side of the milling machine as needed for a particular project. The carrier plate may have a series of longitudinal markings, which may include numeric representations of distance offsets from the sides of the milling machine, at locations corresponding to the series of locator chambers.

The vise stop has a channel portion proximate to a nose of the vise stop, the channel portion shaped to fit over the top of a lip portion of the fixed jaw. The nose of the vise stop extends into the work area of the milling machine and provides a stop against which the workpiece rests. Further, the carrier plate has a recess shaped for receiving the rear of the fixed jaw, the edges of the recess resting alongside either side of the fixed jaw.

The vise stop may be two pieces, including a stop puller and a nose, the two pieces being coupled with one another using a threaded fastener. The pieces may interlock using a protrusion and channel arrangement. In some embodiments the vise stop may be a single piece. The vise stop itself may be millable, enabling a user to prepare a vise stop with a portion cut away to facilitate access to portions of a workpiece for milling that would otherwise be inaccessible due to being blocked by the vise stop.

The foregoing is a summary and thus contains, by necessity, simplifications, generalizations and omissions of detail; consequently, those skilled in the art will appreciate that the summary is illustrative only and is not intended to be in any way limiting. Other aspects, embodiments, features and advantages of the device and/or processes and/or other subject matter described herein will become apparent in the teachings set forth herein.

BRIEF DESCRIPTION OF THE DRAWINGS

Certain embodiments of the present invention are described in detail below with reference to the following drawings.

DETAILED DESCRIPTION

Specific details of certain embodiments of the invention are set forth in the following description and in the figures to provide a thorough understanding of such embodiments. The present invention may have additional embodiments, may be practiced without one or more of the details described for any particular described embodiment, or may have any detail described for one particular embodiment practiced with any other detail described for another embodiment.

Importantly, a grouping of inventive aspects in any particular "embodiment" within this detailed description, and/or a grouping of limitations in the claims presented herein, is not intended to be a limiting disclosure of those particular aspects and/or limitations to that particular embodiment and/or claim. The inventive entity presenting this disclosure fully intends that any disclosed aspect of any embodiment in the detailed description and/or any claim limitation ever presented relative to the instant disclosure and/or any continuing application claiming priority from the instant application (e.g. continuation, continuation-in-part, and/or divisional applications) may be practiced with any other disclosed aspect of any embodiment in the detailed description and/or any claim limitation. Claimed combinations which draw from different embodiments and/or originally-presented claims are fully within the possession of the inventive entity at the time the instant disclosure is being filed. Any future claim comprising any combination of limitations, each such limitation being herein disclosed and therefore having support in the original claims or in the specification as originally filed (or that of any continuing application claiming priority from the instant application), is possessed by the inventive entity at present irrespective of whether such combination is described in the instant specification because all such combinations are viewed by the inventive entity as currently operable without undue experimentation given the disclosure herein and therefore that any such future claim would not represent new matter.

Figure 1:
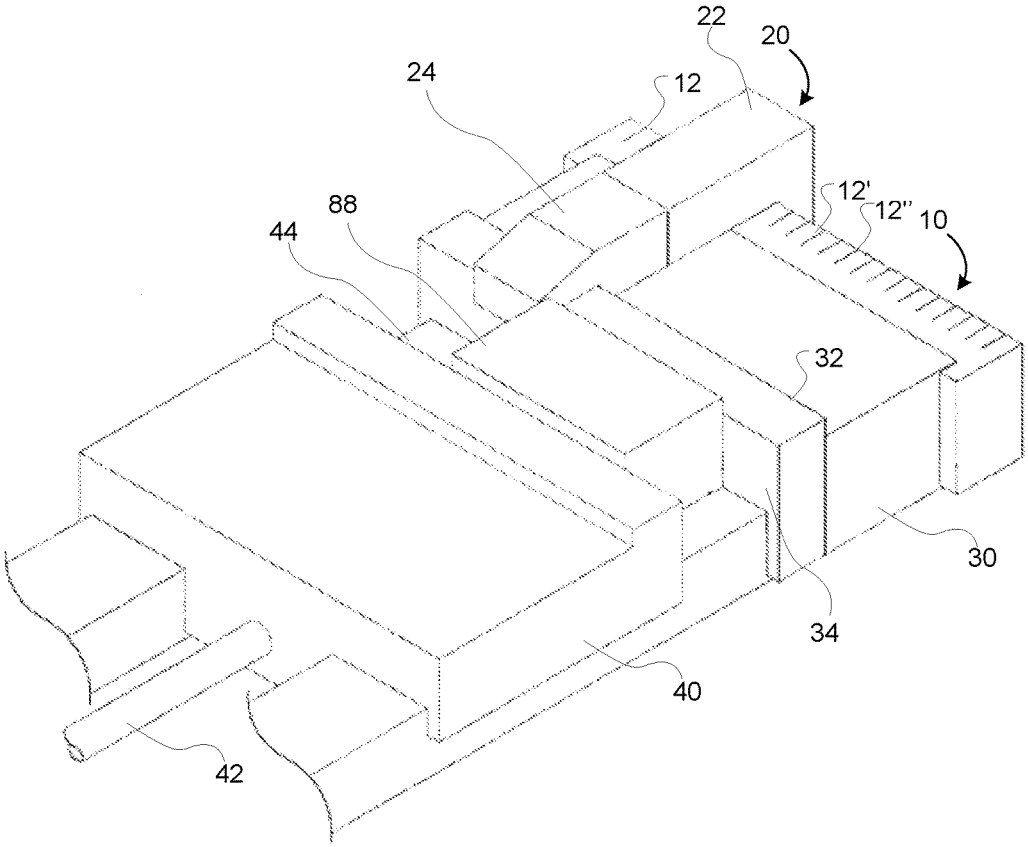
FIG. 1 is a top perspective view of a vise stop arrangement as installed on a milling machine.

FIG. 1 is a top perspective view of a vise stop arrangement as installed on a milling machine, the vise stop arrangement including carrier plate 10 and vise stop 20. A typical milling machine includes a bed 44 on which a workpiece 88 to be milled rests. The workpiece rests against a front face 34 of a fixed jaw 30. A movable jaw 40 is capable of being moved longitudinally (that is, in the direction of travel from the front of the milling machine to the rear) via actuation of a handle (not shown) that drives a worm screw 42. The fixed jaw includes a lip portion 32 with a higher vertical profile than the remainder of the fixed jaw. The fixed jaw, movable jaw, bed, and worm screw are all known components of a prior art milling machine and form no part of the disclosed invention. As will be seen, use of the vise stop arrangement which comprises the invention includes affixing the carrier plate to a rear portion of the fixed jaw and interlocking of the vise stop with the carrier plate at a particular lateral offset indicated by one of the plurality of longitudinal markings (certain of the longitudinal markings denoted in FIG. 1 as 12, 12', and 12"), the vise stop further engaging the lip portion of the fixed jaw of the milling machine. Upon the vise stop arrangement being coupled with the milling machine, the workpiece rests against a nose portion of the vise stop which serves as an abutment to prevent the workpiece from sliding laterally while wedged between the fixed jaw and movable jaw. The vise stop may be two pieces, including a nose 24 and a stop puller 22, to further facilitate coupling with the fixed jaw.

Figure 2A:
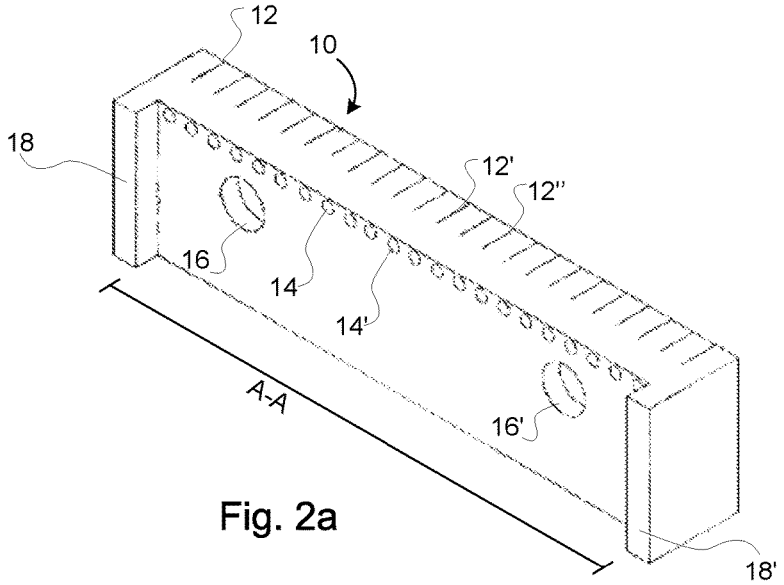
FIGS. 2*a*, 2*b*, 2*c*, and 2*d* are a perspective view, a front view, a top view, and a side cutaway view of a carrier plate of the vise stop arrangement.
Figure 2B:
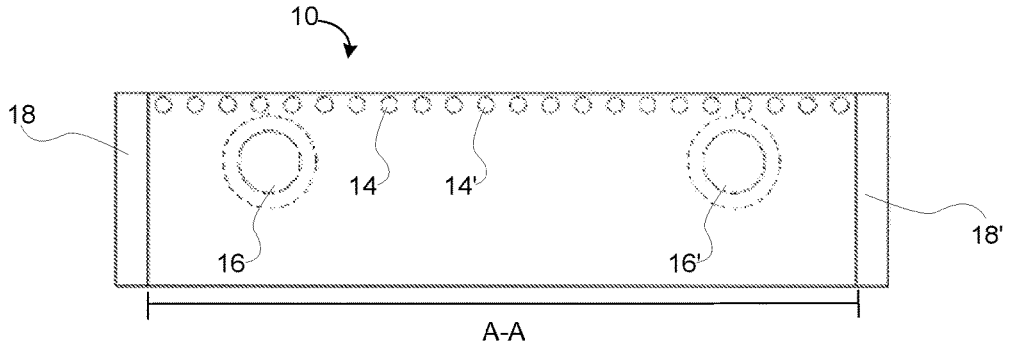
Figure 2C:
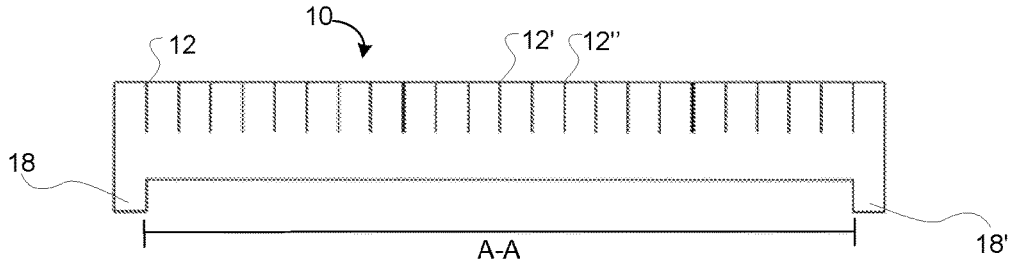
Figure 2D:
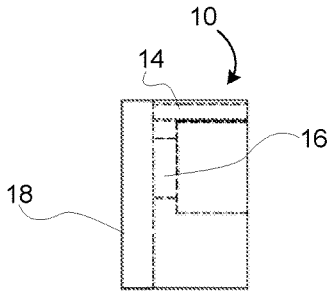
Figure 2E:
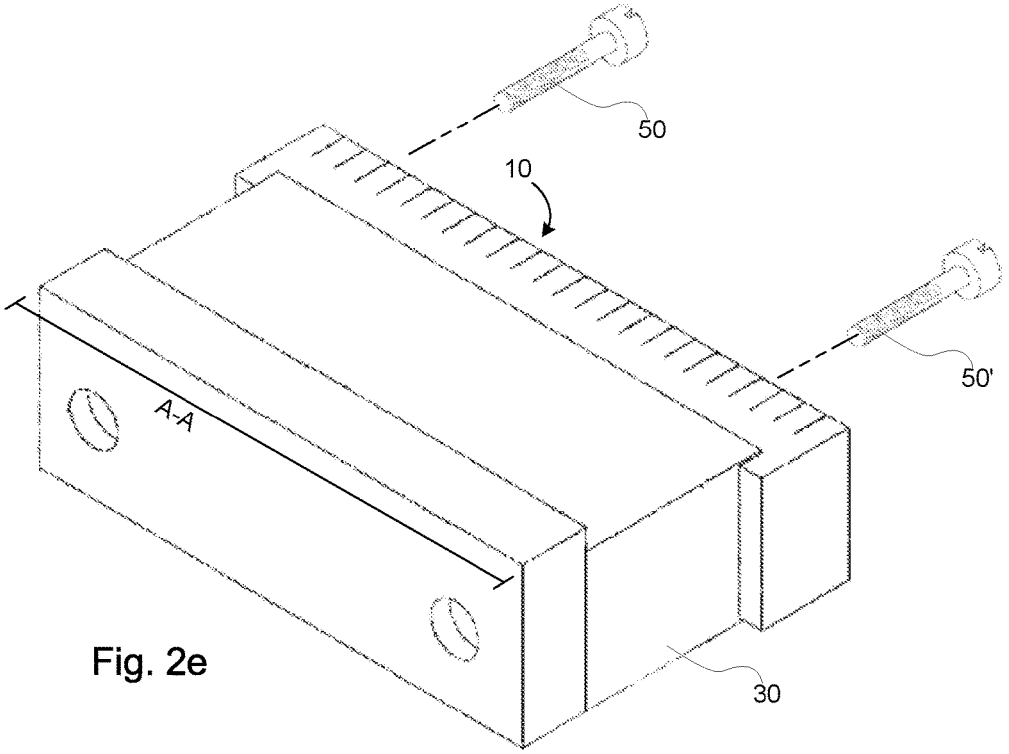
FIG. 2*e* is an environmental perspective view depicting the carrier plate affixed to a fixed vise jaw of a milling machine, with the remaining components of the milling machine not shown for clarity.

FIGS. 2*a*, 2*b*, 2*c*, and 2*d* are a perspective view, a front view, a top view, and a side cutaway view of a carrier plate of the vise stop arrangement. FIG. 2*e* is an environmental perspective view depicting the carrier plate affixed to a fixed vise jaw of a milling machine, with the remaining components of the milling machine not shown for clarity. The carrier plate 10 includes a fixed jaw recess at the front face of the carrier plate, the fixed jaw recess defined as the opening between the first side wall of the carrier plate 18 and second side wall of the carrier plate 18'. The width of the fixed jaw recess (i.e. the length of the interior face of the carrier plate between the first and second side walls) is depicted as width A-A in the figures, and is substantially the same as the width of the fixed jaw of the milling machine such that the rear of the fixed jaw may nestle into the fixed jaw recess of the carrier plate. (Substantially the same herein means a difference in size between the referenced components only large enough to permit entry of one component into the other, with a slight amount of frictional tension in between the two components. The difference between them may be, for example, as small as 0.01 inches and no more than 0.1 inches. It will be apparent to one with skill in the art what tolerance is appropriate to provide some degree of frictional tension between the two pieces when, for example, the carrier plate is placed against the fixed jaw such that the rear portion of the jaw nestles into the fixed jaw recess of the carrier plate.)

The carrier plate is affixed to the fixed jaw by passing fasteners 50 and 50' through two mounting chambers 16 and 16', which are two counterbore holes disposed from the rear of the carrier plate to the front of the carrier plate (the wide portion of the counterbore being disposed through the rear of the carrier plate and the narrow portion of the counterbore disposed through the front portion of the carrier plate). The two mounting chambers disposed through the carrier plate are aligned with screw holes tapped through the rear portion of the fixed jaw. Upon the fasteners being passed through the mounting chambers of the carrier plate that are aligned with the screw holes and tightened, the carrier plate is securably mounted to the fixed jaw of the vise.

A plurality of locator chambers are disposed from side to side of the carrier plate. Certain of the locator chambers are denoted 14 and 14' in FIGS. 2*a* and 2*b*. While the locator chambers are depicted as cylindrical, other shapes are possible for the locator chambers (such as hexagonal, torx-shaped, or other appropriate shape for the locator chambers). On the top surface of the carrier plate is a plurality of longitudinal markings, certain of which are denoted in FIGS. 2*a* and 2*c* as 12, 12', and 12". Numbers may be present atop the carrier plate in between the longitudinal markings, each number corresponding to a particular locator chambers. As will be seen, the longitudinal markings and/or numbers enable an operator to choose a particular lateral offset from the side of the milling machine for coupling the vise stop, ensuring that the vise stop is located at a constant offset from the side of the milling machine and the milling tool. Accordingly, a particular milling project can be undertaken in which the workpiece to be milled is placed in a particular position proximate to the milling tool, where that particular position is easily located in a subsequent instance of the milling project being undertaken irrespective of the vise stop having been moved in between the two instances of the milling project.

Figure 3:
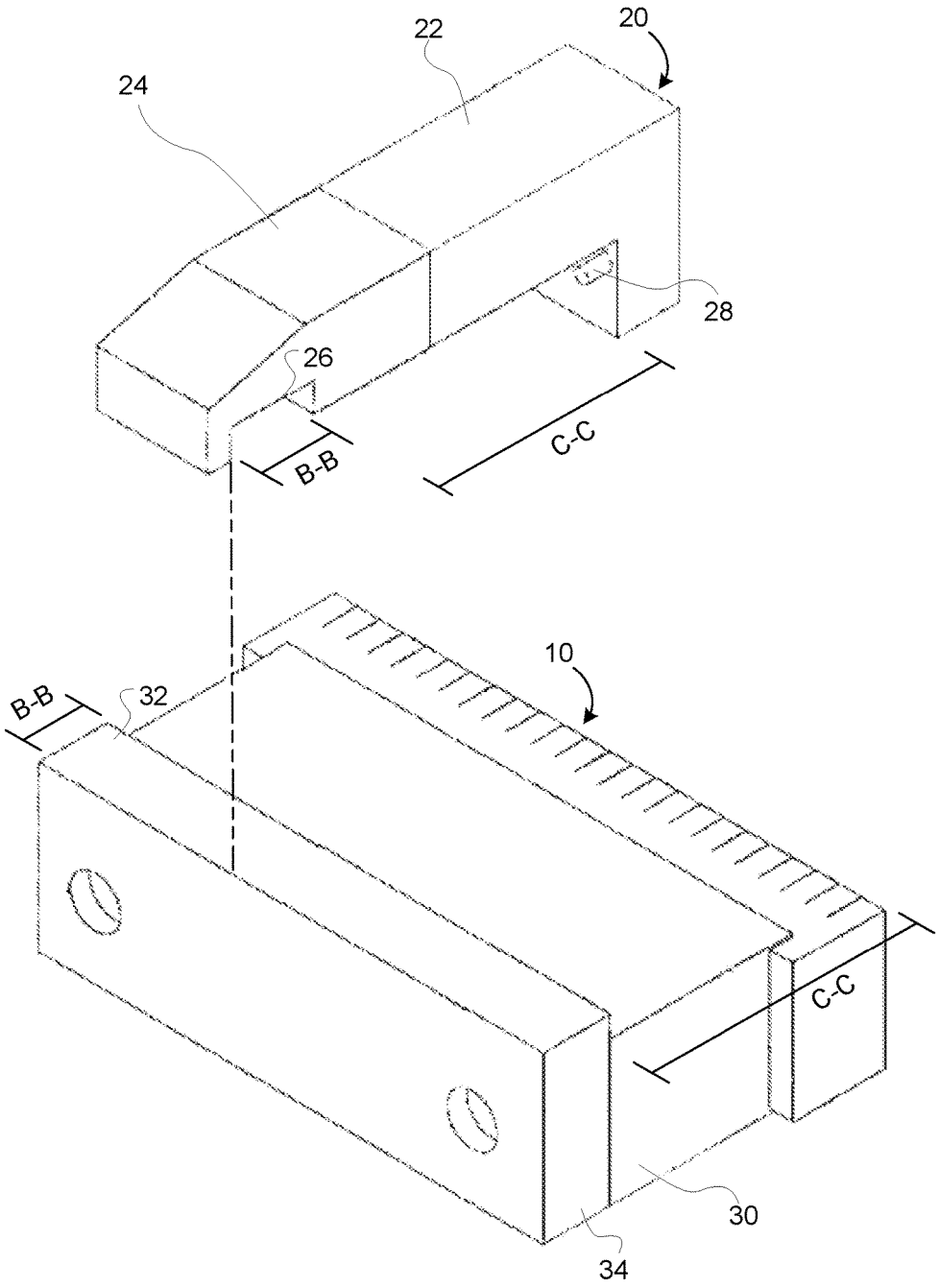
FIG. 3 is an exploded perspective view depicting a carrier plate which has been affixed to a fixed jaw and a vise stop above the combined carrier plate and vise jaw.

FIG. 3 is an exploded perspective view depicting a carrier plate which has been affixed to a fixed jaw and a vise stop above the combined carrier plate and vise jaw. The exploded view is provided to amplify particular dimensional relationships between the fixed jaw 30, carrier plate 10, and vise stop 20. Particularly, a length B-B is depicted which shows the longitudinal depth of the front face 34 of the fixed jaw, the length B-B being substantially the same as the rectangular channel vise stop arm 26, the rectangular channel vise stop arm being a cutout from the vise stop having substantially the same dimension as the longitudinal depth of the front face of the fixed jaw. Length B-B enables the vise stop to interface with the fixed jaw lip 32 via the rectangular channel vise stop arm of the vise stop, supporting the vise stop on top of the fixed jaw and aiding in preventing any movement from side to side (i.e. securably fitting the rectangular channel vise stop arm over the fixed jaw lip) so as to not stress the dowel pins 28 of the nose stop at their interface with the carrier plate (said interface being discussed below). Further, it may be seen that a length C-C extends from the rearward aspect of the rectangular channel vise stop arm to a front face of the vise stop which rests against the rear face of the carrier plate upon the vise stop being coupled with the carrier plate. It will be seen in the description that follows that a two-piece construction of the vise stop (the referenced two pieces including nose 24 and stop puller 22) enables the vise stop to have an adjustable longitudinal depth along length C-C, such that the vise stop arrangement may be adaptable to varying depth fixed jaws.

Figure 4:
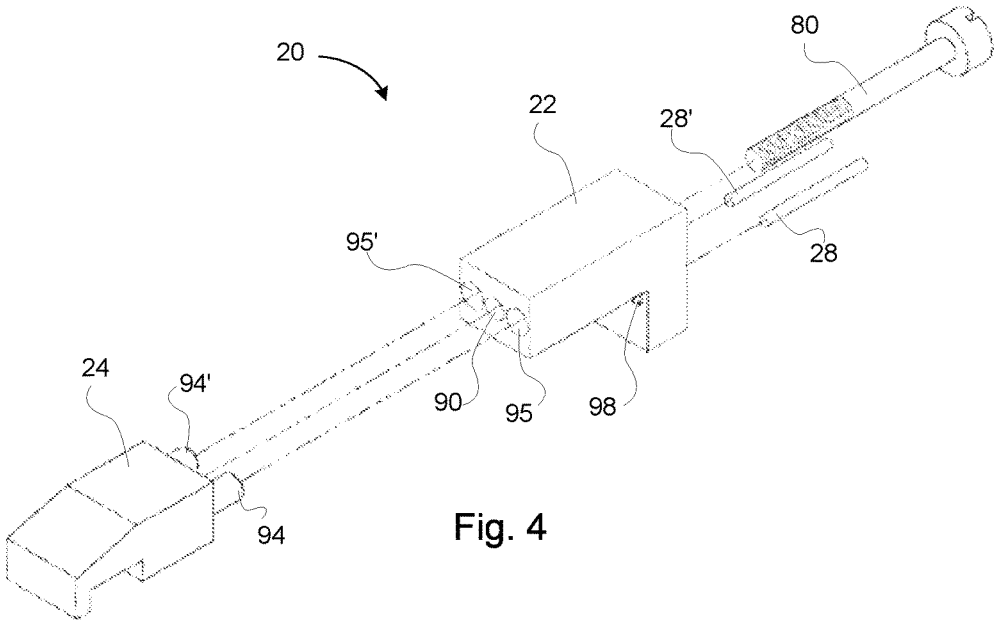
FIG. 4 is an exploded perspective view of a vise stop of the vise stop arrangement.
Figure 5A:
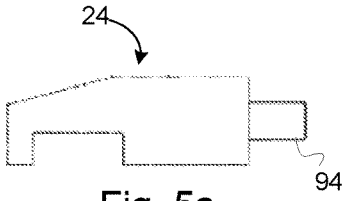
FIGS. 5*a* and 5*b* are a side view and a rear view of a nose of the vise stop.
Figure 5B:
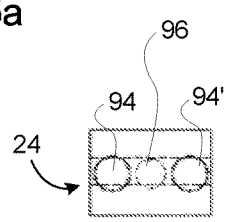
Figure 6A:
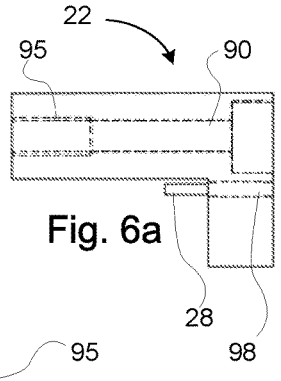
FIGS. 6*a* and 6*b* are a side view and a front view of a stop puller of the vise stop.
Figure 6B:
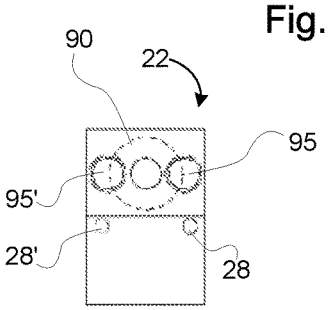

FIG. 4 is an exploded perspective view of a vise stop of the vise stop arrangement. FIGS. 5*a* and 5*b* are a side view and a rear view of a nose of the vise stop. FIGS. 6*a* and 6*b* are a side view and a front view of a stop puller of the vise stop. The vise stop 20 may include nose 24 and stop puller 22, the nose and stop puller being coupled using threaded fastener 80.

The nose includes two protrusions 94 and 94' protruding from the rear face of the nose and which, when the nose and stop puller are joined, mate with stop puller side chambers 95 and 95' which are drilled into the front face of the stop puller. The nose also includes a nose central chamber 96 which is drilled and tapped through the rear face of the nose between the protrusions. When the nose and stop puller are joined, the nose central chamber aligns with a central chamber 90 of the stop puller, which is a counterbore hole disposed from the rear face of the stop puller to the front face of the stop puller (the wide portion of the counterbore being disposed through the rear face of the stop puller and the narrow portion of the counterbore disposed through the front face of the stop puller). Once the nose and stop puller are pressed together, including insertion of the protrusions of the nose into the stop puller side chambers, a threaded fastener 80 may be inserted into the stop puller central chamber through the aperture of the rear face of the stop puller. The threaded fastener may then be threaded into the nose central chamber and tightened to form the vise stop. It may be seen that the threaded fastener may be used to alter an overall depth of the vise stop. That is, the vise stop may be used with fixed jaws having a different depth through adjustment of the threaded fastener which threads into the nose. Loosening the threaded fastener would lengthen the length C-C depicted in FIG. 3, making the vise stop usable with a fixed jaw having a different longitudinal depth.

The stop puller 22 may have two dowels protruding from a front face of the stop puller that rests adjacent to the rear face of the carrier plate. The dowels may be disposed through stop puller pin chambers 98 which are disposed through the stop puller. The lateral offset between two dowels of the stop puller is the same as the offsets between adjacent locator chambers as depicted in FIGS. 2*a* and 2*b*.

While the stop puller is depicted with two dowels herein, it is possible that three or more dowels could be provided. Likewise, while the nose is depicted with two protrusions, the interlock capability of the nose and stop puller could be provided with three or more protrusions. Further, while the protrusions are depicted as cylindrical, other shapes may be used such as hexagonal, torx-shaped, or other appropriately-shaped protrusions.

Coupling of the vise stop arrangement to a milling machine encompasses the following operations: (1) affixing the carrier plate to the fixed jaw as described above; (2) resting the nose of the vise stop on top of the fixed jaw with the rectangular channel vise stop arm fitted over the lip portion of the fixed jaw; (3) resting the stop puller on top of the fixed jaw while aligning an edge of the stop puller with a particular longitudinal marking of the carrier plate as needed for a particular project; (4) sliding the nose laterally along the lip portion of the fixed jaw to align longitudinally with the stop puller; (5) pulling the stop puller forward, including inserting dowels of the stop puller into the locator chambers of the carrier plate and inserting the protrusions of the nose into the stop puller side chambers while maintaining the desired alignment of the edge of the stop puller with the particular longitudinal marking of the carrier plate; and (6) tightening a threaded fastener inserted into the rear face of the stop puller through the stop puller central chamber and threaded into the nose central chamber, the tightening action affixing the stop puller to the coupled carrier plate and fixed jaw as depicted in FIG. 1.

Once the vise stop arrangement is coupled with the fixed jaw, a workpiece may be rested against the vise stop and the movable jaw may be moved towards the workpiece using the worm screw until the workpiece is wedged between the fixed and movable jaws and the vise stop. The workpiece may then be milled without concern for the workpiece sliding from side to side during a milling operation.

In some embodiments, the vise stop is itself machinable. Through milling away a portion of the vise stop, a machinist may be able to leave the stop in place during particular machining operations that would otherwise require moving the workpiece itself to reach a particular portion of the workpiece.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of this subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

While preferred and alternative embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A vise stop arrangement, comprising:
a carrier plate, the carrier plate including at least:
a fixed jaw recess;
at least two mounting chambers; and
at least two locator chambers,
wherein a top surface of the carrier plate includes at least two longitudinal markings corresponding to the at least two locator chambers; and
a vise stop, the vise stop including at least:
a rectangular channel vise stop arm; and
at least two dowel pins.

2. The vise stop arrangement of claim 1, wherein a lateral offset between the at least two dowel pins is equal to a lateral offset of the at least two locator chambers.

3. The vise stop arrangement of claim 1, wherein the at least two dowel pins and the at least two locator chambers are cylindrical.

4. The vise stop arrangement of claim 1, wherein the at least two dowel pins are disposed through at least two pin chambers of the vise stop.

5. The vise stop arrangement of claim 1, wherein the fixed jaw recess is configured for receiving a portion of a fixed jaw of a vise.

6. The vise stop arrangement of claim 5, wherein the fixed jaw recess includes at least a first side wall and a second side wall against which the portion of the fixed jaw of the vise rest.

7. The vise stop arrangement of claim 1, wherein the carrier plate securably mounts to a fixed jaw of a vise.

8. The vise stop arrangement of claim 1, wherein at least two threaded fasteners pass through the at least two mounting chambers of the carrier plate to securably mount the carrier plate to the fixed jaw of the vise.

9. The vise stop arrangement of claim 8, wherein the at least two mounting chambers are counterbored holes leading to the fixed jaw recess, an enlarged portion of the counterbored holes disposed opposite the fixed jaw recess.

10. The vise stop arrangement of claim 9, wherein the at least two counterbored holes are spaced laterally for mating with at least two screw holes of a fixed jaw of a vise to which the carrier plate may be securably mounted via the at least two threaded fasteners passed through the at least two mounting chambers of the carrier plate.

11. The vise stop arrangement of claim 1, wherein the fixed jaw recess includes a carrier plate interior face having a length approximately equal to a width of a fixed jaw of a vise to which the carrier plate may be securably mounted.

12. The vise stop arrangement of claim 1, wherein the vise stop is a single element.

13. The vise stop arrangement of claim 1, wherein at least a portion of the vise stop is capable of being machined.

14. The vise stop arrangement of claim 1, wherein a longitudinal marking is a marking that indicates a particular lateral offset from a side of a milling machine at which the vise stop arrangement is coupled via the at least two dowel pins and the at least two locator chambers, the side of the milling machine running longitudinally parallel to a worm screw longitudinally driving a movable jaw of the milling machine.

15. The vise stop arrangement of claim 14, wherein the longitudinal marking is at least one of a line, a dot, a number, or other symbol.

16. A vise stop arrangement, comprising:

a carrier plate, the carrier plate including at least:

a fixed jaw recess;

at least two mounting chambers; and at least two locator chambers;

a vise stop, the vise stop including at least:

a rectangular channel vise stop arm, wherein the rectangular channel vise stop arm includes a recess dimensionally configured for securably fitting over a lip of a fixed vise jaw; and at least two dowel pins.

17. The vise stop arrangement of claim 16, wherein the vise stop is a single element.

18. A vise stop arrangement, comprising:

a carrier plate, the carrier plate including at least:

a fixed jaw recess;

at least two mounting chambers; and at least two locator chambers;

a vise stop, the vise stop including at least:

a nose, the nose including at least a rectangular channel vise stop arm; and a stop puller, the stop puller including at least two dowel pins, wherein the nose and the stop puller are couplable with each other via a fastener.

19. The vise stop arrangement of claim 18, wherein a depth of the vise stop is adjustable via adjustment of the fastener, the adjustment of the fastener changing a distance of the nose from the stop puller.

20. The vise stop arrangement of claim 18, wherein the nose includes at least two protrusions configured for being securably received by at least two side chambers of the stop puller.

* * * * *